US006209917B1

(12) United States Patent
Welch

(10) Patent No.: US 6,209,917 B1
(45) Date of Patent: Apr. 3, 2001

(54) UNIBODY BINDER AND THE PROCESS OF MAKING THE BINDER

(76) Inventor: Stephen R. Welch, 1085 Flamingo Dr., Roselle, IL (US) 60172

( * ) Notice: Subject to any disclaimer, the term of this patent is extended or adjusted under 35 U.S.C. 154(b) by 0 days.

(21) Appl. No.: 09/408,399

(22) Filed: Sep. 29, 1999

Related U.S. Application Data

(63) Continuation of application No. 09/148,888, filed on Sep. 8, 1998.

(51) Int. Cl.[7] ..... B42D 3/00

(52) U.S. Cl. ..... 281/36; 281/29; 402/70; 402/73

(58) Field of Search ..... 412/1–4, 24, 17, 412/19, 22, 30, 31; 402/70, 73; 281/29, 36, 37

(56) References Cited

U.S. PATENT DOCUMENTS

| | | | | |
|---|---|---|---|---|
| D. 379,896 | * | 6/1997 | Friedman | D6/632 |
| 5,501,326 | * | 3/1996 | Shuhsiang | 206/307 |
| 5,575,504 | * | 11/1996 | Wagner | 281/29 |
| 5,607,246 | * | 3/1997 | Podosek | 402/73 |
| 5,620,207 | * | 4/1997 | Podosek et al. | 281/29 |
| 5,800,110 | * | 9/1998 | Georgitsis et al. | 412/3 |
| 5,876,143 | * | 3/1999 | Ong | 402/3 |

* cited by examiner

*Primary Examiner*—Willmon Fridie, Jr.

(57) ABSTRACT

The invention includes novel unibody binder constructions and the process of making same. The binder is composed of two plastic sheets comprising such material as polyvinyl chloride, polyolefin, polypropylene, polyvinyl acetate or other similar plastics. An uncompromised single piece of board or similar rigid material, such as chipboard, microflute board, corrugated board, fiberboard, etc., or a synthetic substrate, is then coated with a glue such as a resin glue, a U.V. adhesive, etc., on both sides and sandwiched between the plastic sheets. This sandwich is then formed into the unibody construction by welding the entire outer perimeter. At the time of welding, the air between the plastic sheets and the board is pressed or vacuumed out. To create the hinges on the binder, the unibody construction is then hydraulically creased to the extent necessary by using three moving blades to provide living hinges. Many different spine configurations may be achieved depending on the number of creases desired for flexibility. Various capacities of ring metals may be accommodated by increasing or decreasing the number of creases or distances therebetween. Also, various round or flat back profiles can be formed after the flat board has been sealed into a sandwich between two plastic sheets that have been welded together. A clear plastic sheet secured to the bottom and side edges of the outer plastic sheet to provide a pocket for visible inserts and plastic sheets can be secured to the inner plastic sheet to provide inner pockets for inserts.

11 Claims, 6 Drawing Sheets

UNIBODY BINDER AND THE PROCESS OF MAKING THE BINDER

This application is a continuation application Ser. No. 09/148,888 entitled Unibody Binder filed Sep. 8, 1998

TECHNICAL FIELD

Field of invention relates to binders that are mass produced and capable of accommodating variable ring sizes. The binders in question are of the type that are used in schools, offices, homes and factories.

BACKGROUND OF THE INVENTION

There are currently in the marketplace two types of traditional heat-sealed vinyl binders. One consists of a three-piece board construction that is welded together wherein a plastic material surrounds the three separate pieces and the hinges are formed by the plastic coverings being welded together between the spine and the front and back covers. The welded construction of this type of binder results in relatively weak hinge constructions that tend to fail with the covers pulling away from the spine. In the other traditional type, there is some connectivity or webbing taking place with the board, either the board has been slotted in the hinge areas, or it has been routed in the hinge areas, or the three pieces of board have been joined with a flexible backing. See the prior art illustrated in FIGS. 1A–D. In any case, the hinge areas are still substantially weak resulting in the covers severing from the spine. Examples of these board segmented constructions are illustrated in U.S. Pat. Nos. 5,222,825 and 5,620,207.

Another type of binder construction that has been employed is disclosed in British Patent 1,123,779. This patent discloses a binder in which a board is covered by plastic sheets that are welded to the board. However, it was found necessary to compromise the board by forming a cut-out portion at each end of a fold and thus reduces the strength of the board at the fold lines which obviously weakens the binder in these areas. There is also no teaching of providing a generally arcuate spine arrangement that is not weakened at any section thereof.

It can be appreciated that the aforementioned constructions have a number of inherent disadvantages that if overcome would be a substantial advance in the art and serve a long felt need to provide a binder with a much longer shelf life than is currently available. With the current construction the areas where the spine of the conventional binder hinges with the front and back covers have been substantially weakened by the welding in the hinge area. For example, in welding two pieces of 0.015 gauge thermoplastic material, the resultant thickness is not the expected 0.030 gauge but is approximately 0.020 gauge or less. The welding process forces the flexible plasticizers away from the welded area because pressure is used to create a bond and inevitably there is always a decrease in plasticizers and a resultant loss in dimensional stability in any welded area.

Additionally when the binder is fully loaded with paper, there are additional stresses placed on the covers of the binder. These stresses are transferred to the area of weakness found in the hinges which further acts to rapidly deteriorate the binder thus substantially reducing its longevity.

Of primary concern is that in the conventional binder the material forming the binder has been drastically compromised by milling, routing or slotting to facilitate the formation of the hinges which brings about the weaknesses above referred to. In addition this compromising of the board strength not only increases the likelihood of hinge failure and cover separation but it can also create a wobbling effect that does not allow the binders to stand up on their own when loaded with paper.

Another disadvantage of current binder constructions that need correcting is the ability to permit the binder producer to not have to predetermine what configuration the binder construction is to be ultimately fashioned until specific orders are received. This is not possible with currently available types since the milling, routing or slotting referred to must be done before the plastic sheets forming the final binder are secured to the underlying board via the heat sealing process, and are also predetermined by the tooling used to heat seal the plastic sheets around the board. It would be a substantial advantage to have the sandwich of board and surrounding plastic sheets stacked and available to be formed into any desired configuration (i.e. round back, flat back etc.) and the instant invention would allow the configuration to be determined after the final casing has been constructed, thus reducing inventory and lead times.

Also, under current practice the final construction for the capacity of the ring metal must be selected prior to welding the film to the board since the size and shape of the binder are predetermined because of the tooling and board specifications.

It remains to mention that the current manufacturing steps being employed as disclosed in U.S. Pat. No. 5,620,207 result in protuberances that are large and unsightly if not dealt with. These are often overcome by notching the board which further weakens the binder by reducing the amount of material at critical junctures or by welding a notch to hide the protuberences which changes the dimensional stability of the plastic covering and weakens it.

It can be appreciated that it would be desirable to have a one piece uniformly strong binder in which the rigid thickness of the cover continues throughout the hinge and is unable to rip or separate. Such a binder would not compromise the board nor have relatively weak hinge lines nor create protuberances or alter the virgin raw materials in the critical failure and stress areas of the hinge. The binder should be capable of using a vinyl or other suitable plastic covering that can be welded and/or glued and/or stitched around the underlying one-piece board. It would be a substantial advance in the art if the binder would have a seamless configuration and include a creased hinge construction that is the same thickness throughout the board and thus does not define a weakened hinge area yet provides a high degree of flexibility that will vary with the number of creases formed.

Also, it would be advantageous to have a binder that is versatile, that can have either a round or a flat spine and can also be changed in size. This can be especially appreciated in manufacturing because of fewer parts, simplification in tooling, and more efficient production procedures.

There has also been a need to provide a vinyl or other plastic covering for the binder that will not delaminate or split and be able to receive a clear plastic overlay to hold information. The clear plastic overlay differs from prior art in that it can extend from the front cover to the back cover and spine without interruption and can be made flat or round after the fact. To facilitate the manufacturing of a binder that overcomes the disadvantages of the prior art the heretofore relatively archaic process used to form binders is not suitable and a new process for manufacturing binders is required.

It is also desirable to be able to provide the inner plastic covering of the binder with partial plastic sheets adhered thereto on three sides to provide pockets into which various materials can be placed.

SUMMARY OF INVENTION

In accordance with the present invention there is provided a seamless binder formed from a solid non-segmented piece of board with the inner and outer layers of the binder consisting of a plastic material that can be connected together in a variety of ways consisting of welding and/or stitching and/or gluing.

The novel process starts with one continuous, non-interrupted piece of board, which may be solid chipboard, paperboard, or corrugated board to save on weight. In any case, the board has not been mechanically altered with creases, scores, or routed channels. The board retains its structural stability because it is in its original state from the mill and has never been compromised.

Next a plastic skin is formed over the board on both sides. This can be done by welding two sheets of plastic together to encapsulate the one-piece board. The plastic material can, for example, consist of a vinyl such as polyvinyl chloride (PVC), a polyolefin, a polyethylene, a polypropylene or a polyvinyl acetate (PVA) or other plastics that may be secured to a board, plank, or substrate forming a unibody construction by welding and/or stitching and/or gluing.

In the preferred process embodiment prior to the welding, a thin layer of glue is spread on the board or the vinyl to make contact complete and form the one-piece design. At this point in the process, the board being used is in a flat unweakened state. The unibody design is then sequentially hydraulically creased using three moving blades, to displace a section of material to form living hinges which function like a "joint" or knuckle, defining the spine section of the binder between the covers where hinging and bending occurs. The thickness of the assembly is continuous across the entire binder. The unique aspect is that in the spine hinge area there is substantially 100% of the material that is throughout the cover, unlike previous binder constructions where material must be sculptured out or cut so the bending can occur. If the unibody construction is not to include gluing this step in the process would be eliminated. Also, if the plastic covers are to be stitched instead of glued the gluing step is eliminated and the stitching is added after the welding step.

The major advantage of the one-piece binder forming the instant invention is that there is no weakened, segmented board or no separate covers and spine. The covers cannot shift, loosen, rip off or pull away from the spine. The spine of the one-piece binder is formed by pressing a series of longitudinal grooves into the sandwich to create a flat or rounded spine between the front and back covers. In a preferred embodiment the inner and outer layers of the plastic materials used can be connected together by radio frequency, dielectric welding, or thermowelding at their edge portions. The solid or hollow or corrugated board can be sandwiched between plastic sheets, held with adhesive and perimeter welded, and then creased as one unit. The board does not get routed or formed prior to welding. After the creases are formed the adjacent positions of the board are bent about the creased spine section to form a binder. A ring mechanism is then suitably secured to the back cover.

In other embodiments of the present invention, the welded plastic coverings can also be glued and/or stitched to the board. Each of these configurations in conjunction with the spine construction is new and novel and is not anticipated by the prior art.

In addition to the novel process for manufacturing the novel and unique unibody binder disclosed the process can be used for forming a unique unibody binder with a fold-over flap which binder can also be converted into an easel or with an extended flap to give it a portfolio appearance.

Also, the unibody binder construction can be provided with a continuous clear vinyl overlay to form a billboard across the front cover, spine, and back cover and with pockets for inserts.

PRIOR ART

In FIGS. 1A, 1B, 1C and 1D there are illustrated four traditional prior art constructions that employ relatively weak hinge constructions that tend to readily fail resulting in the covers pulling away from the spine. The boards are shown in their flat position before being formed into a binder and finished commercially.

Figure 1A:
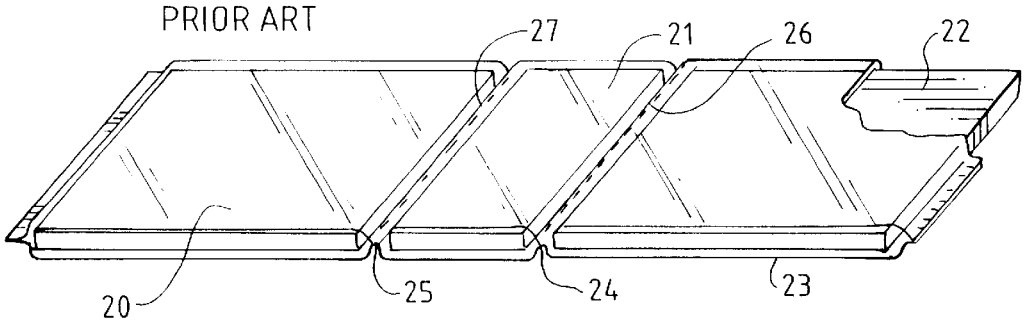
FIG. 1A PRIOR ART
FIG. 1 illustrates several prior art constructions in cross-section.

FIG. 1A illustrates a three piece board construction 20, 21, 22 covered by sheets of vinyl 23 that are welded in position about the boards and opposite portions of the vinyl is welded together at 24, 25 to form hinges 26, 27. With the strength of the hinges merely being the joined plastic it can be appreciated that the hinges are very weak and will not stand up for an extended period.

Figure 1B:
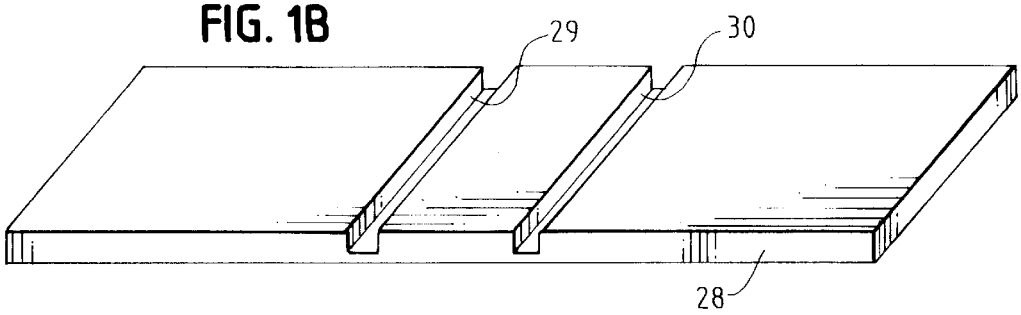

FIG. 1B while using a one piece board 28 is severely compromised at the hinges 29, 30 since the hinges have been formed by routing out the board material to form the hinges. This elimination of the material makes for a weakness that dramatically reduces the life of the binder.

Figure 1C:
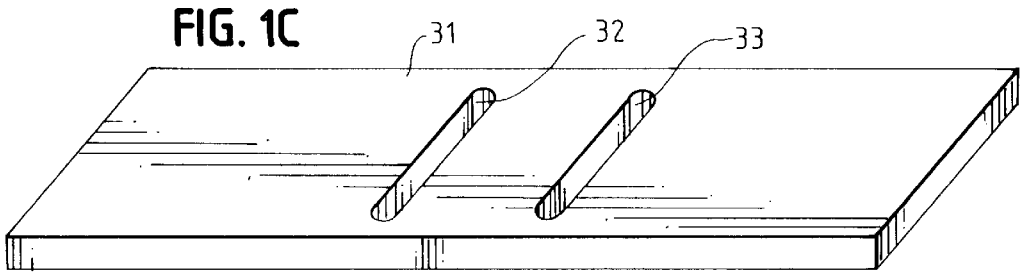

In FIG. 1C there is also employed a single board 31 but here again the slotting that takes place at 32, 33 to form the hinges is subject to the same deficiencies noted with respect to the embodiment shown in FIG. 1B.

Figure 1D:
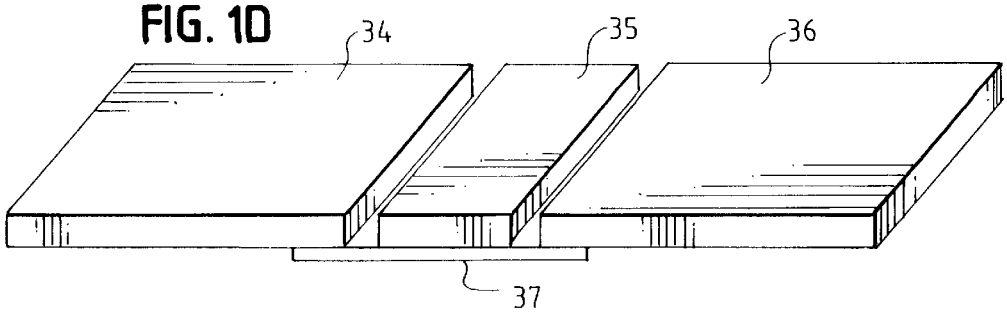

FIG. 1D illustrates another prior art construction in which there are three separate pieces of board 34, 35, 36 connected by a flexible backing or webbing 37 secured thereto which serves as the hinge areas.

DESCRIPTION OF THE PREFERRED AND OTHER EMBODIMENTS AND THE PROCESS OF MAKING SAME

Figure 2:
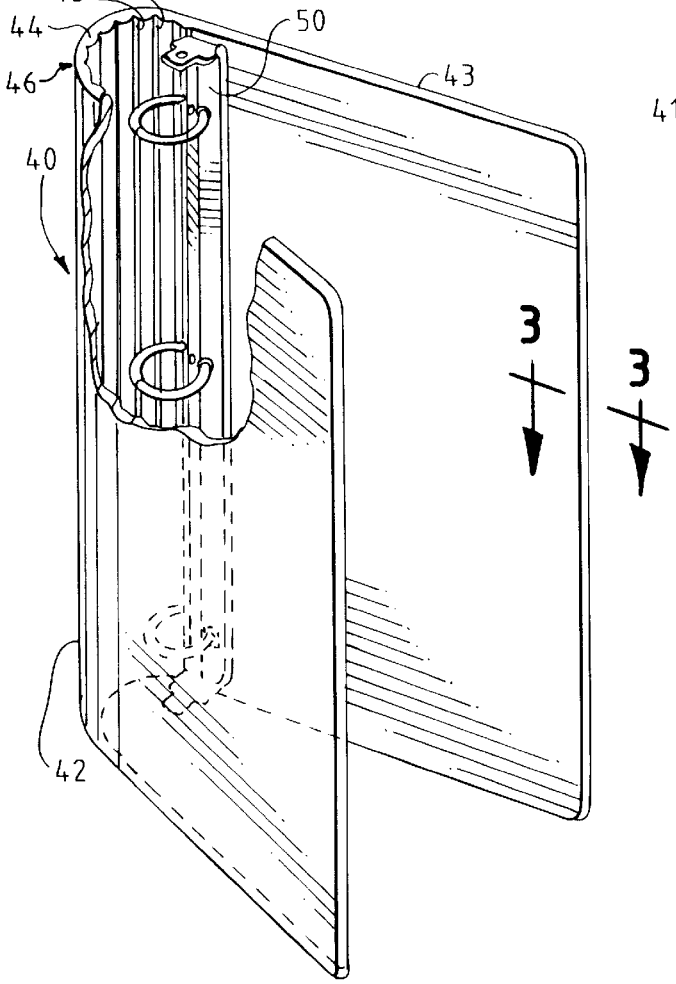
FIG. 2 illustrates a one piece binder with a ring assembly secured to one cover thereof.

In FIG. 2 there is illustrated the novel unibody binder construction 40 in which the primary component consisting of a single piece of board 41 of uniform thickness that is formed into front and back covers 42, 43 by a hinge construction 44 consisting of a series of longitudinally extending creases 45 that are pressed into the board 41 and formed into a rounded spine section 46. A three ring mechanism 50 is secured by rivets (not shown) to the back cover 43. There is no reduction in the thickness of board 41 in any section thereof. While a three ring mechanism has been illustrated this is by way of example only since it can be two ring, four ring etc.

The unibody construction used to form the binder consists of the flat board 41 that is made into a sandwich between two sheets of plastic material 51, 52 that are secured to the board by welding and/or stitching and/or gluing before the spine is formed by creasing and the ring mechanism inserted. The novel process for forming a plastic covered unibody construction will be discussed in connection with FIGS. 7A–D and 8.

Figure 3:
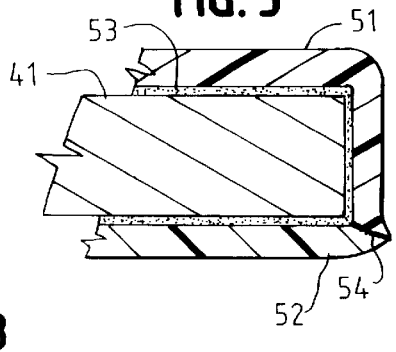
FIG. 3 is a view taken along the line 3—3 of FIG. 2 in which the outer and inner plastic covers are welded and glued to the board.

In so far as the various unibody constructions are concerned reference is made to FIG. 3 wherein the single fiberboard 41 is covered on both sides thereof with plastic sheets 51, 52. The sheets are first glued to the board 41 by glue 53 and then they are dielectrically or radio frequency welded or thermowelded at 54 to seal the plastic over the board like a skin. The plastic material can, for example, consist of a vinyl such as polyvinyl chloride (PVC), a polyolefin, a polyethylene, a polypropylene or a polyvinyl acetate (PVA). The novel process for forming a binder will be described in connection with this embodiment when discussing FIGS. 7A–D and 8. When other unibody constructions such as illustrated in FIGS. 4 or 5 are being formed the modified process to be used will be described.

Figure 4:
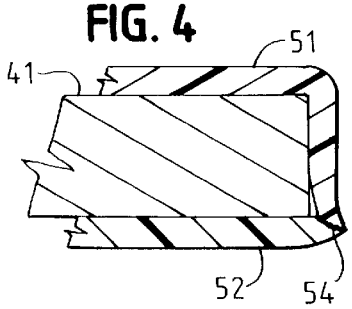
FIG. 4 is an embodiment in which the plastic material is only welded in position about the board.

In FIG. 4 the inner and outer plastic sheets 51, 52 are overlaid and are welded together as aforementioned at 54. No glue is used. Welded edges do not separate.

Figure 5:
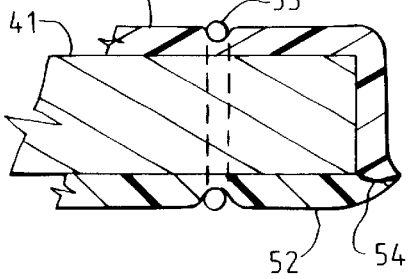
FIG. 5 is an embodiment in which the plastic material is welded and stitched to the board.

The embodiment shown in FIG. 5 is similar to FIG. 4 except that to further reinforce the connection between the outer plastic layers 51, 52 to the board 41 the plastic sheets 51, 52 are stitched to the board by stitching 55 that extends around the perimeter of the binder.

Figure 6:
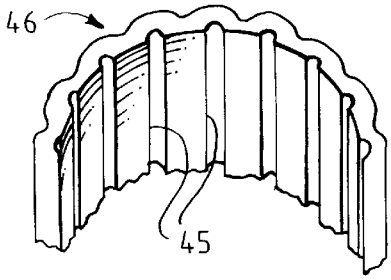
FIG. 6 is an enlarged perspective view of a section of the creased spine shown in FIG. 2 to illustrate its generally uniform thickness throughout.
Figure 9:
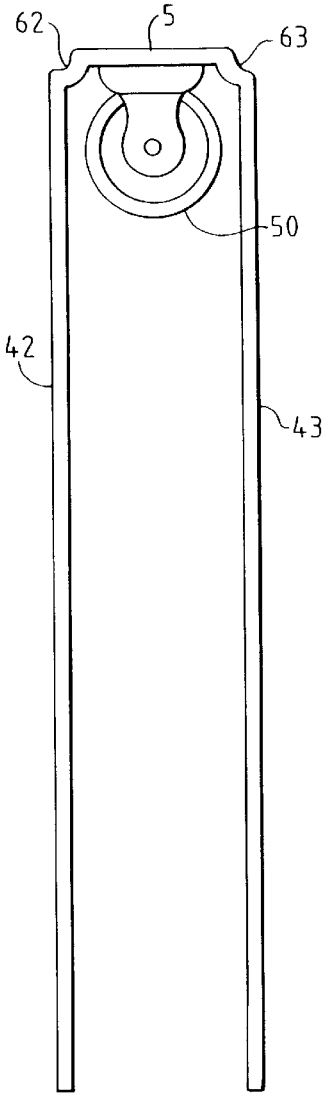
FIG. 9 illustrates a unibody binder construction formed into a flat spine with two hinges.

The various unibody constructions disclosed can be stacked and stored until they are to be formed such as shown in FIG. 2 and other embodiments to be described hereinafter. In accordance with the present invention to insure maximum strength the binder is to be hinged between the front and back covers by a series of hinges that have a thickness throughout that is substantially that of the front and back covers. By maintaining this uniform thickness the spine portion of the binder formed by the living hinges are over 500% stronger than that of the prior art arrangements disclosed and illustrated in FIGS. 1A–D. The hinges are formed by longitudinally extending creases 45 that are pressed into an intermediate section of the board throughout its length by a series of steps to be hereinafter described. The creases are formed by displacing material and not removing material. This can best be illustrated in FIG. 6 which an enlarged perspective view of a section of the spine shown in FIG. 2. The number of creases and thus hinges that are formed will determine its flexibility. In FIG. 9 where a flat spine is desired there are two hinges whereas in FIGS. 2 and 10 where a round spine is desired a substantial number of creases are formed.

By reducing the maximum flex on any hinge and the additive effect of multiple hinges the vinyl and board life are further extended. The softer the resultant bend the lower stress force on the board and depending on the number of creases the smaller the resultant angle after forming and creasing the board. The smaller the angle the more stable the outer fibers. When the creasing system is employed since there is no thinning of the board in the area the creasing systems substantially outlast the conventional hinging arrangement where substantial weakening takes place and makes for a very short life binder.

Figure 7A:
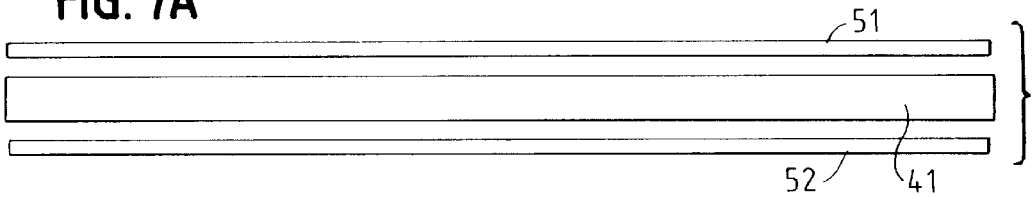
FIGS. 7A, 7B, 7C and 7D show the formation stages of the assembly of the unibody binder before binder formation and insertion of the ring holder.
Figure 7B:
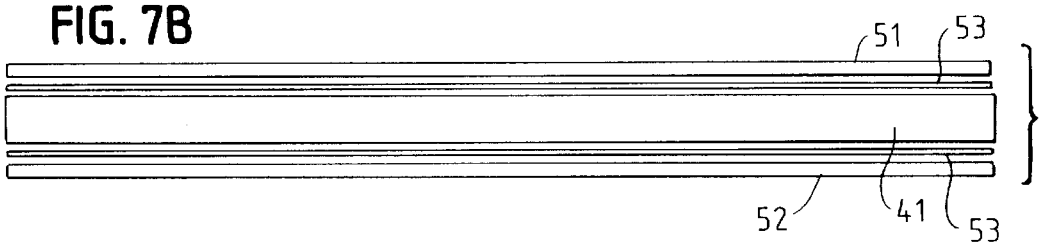
Figure 7C:
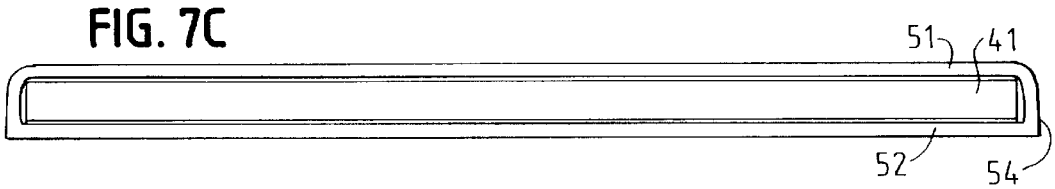

We turn now to the novel process for the formation of the sandwich board of the type disclosed in FIG. 3 into the binder of the type shown in FIG. 2. There is initially provided as shown in FIG. 7A a board 41 disposed between two plastic sheets 51, 52. Glue 53 is then introduced between sheet 51 and board 41 and between sheet 52 and board 41 (7B). Following this, the assemblage is pressed together and the sheets 51, 52 are dialectically or radio frequency welded or thermowelded at 54 (7C). The board assembly is now ready to be creased to form the binder. This can be done in-line immediately after the board formation as shown in FIG. 7C or the formed boards can be stacked in inventory to await determination of the spine to be formed. For illustrative purposes there will be described the subsequent formation of a crease that will be duplicated to form a flat back spine of the type shown in FIG. 9.

Figure 7D:
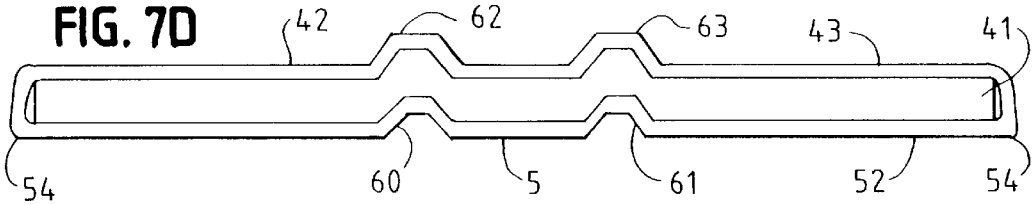
Figure 8:
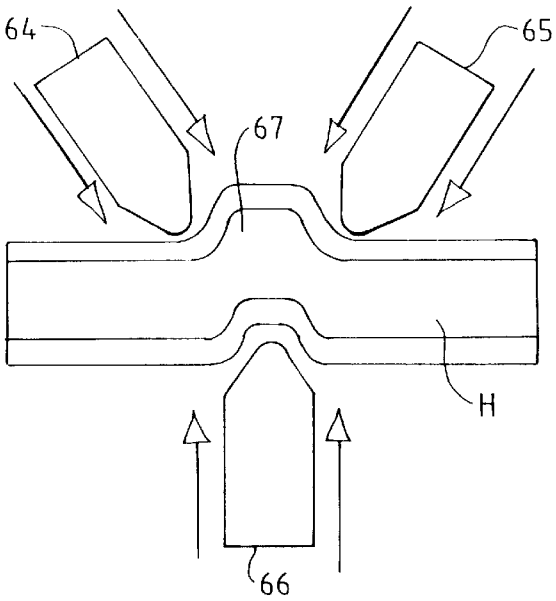
FIG. 8 is a schematic illustration of a mechanism for forming a crease.
Figure 10:
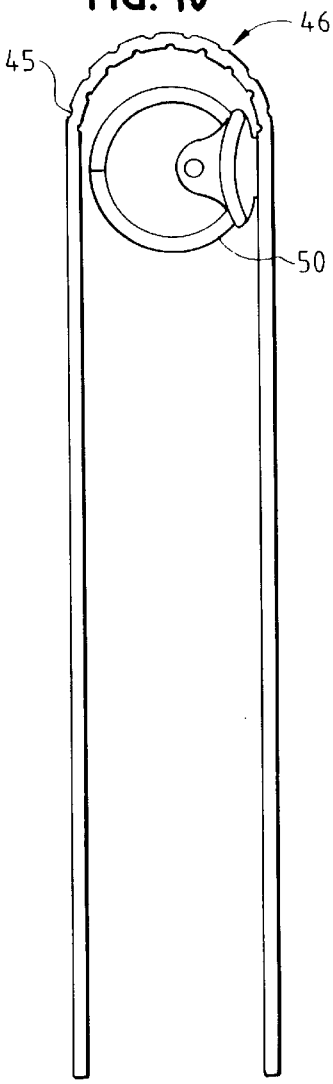
FIG. 10 illustrates a unibody binder construction in which the spine is formed with a substantial number of hinges to form a round spine.

To form the creases 60, 61 that define the living hinges 62, 63 for the front cover 42 and back cover 43 relative to the spine S a computer controlled reciprocating elongated blade construction of the type schematically illustrated in FIG. 8 is used. The blades extend across the full width of the board. While blades 64, 65, 66 are illustrated other equivalent mechanisms can be employed. When the board reaches a prescribed station adjacent the blade assemblage the blades 64, 65, 66 are moved inwardly in the manner shown to displace the material 67 to form a hinge H. The blades are then automatically retracted and the board 41 moved a predetermined amount after which the blades are again activated by computer controls to again contact the board to form another hinge. If a flat back binder 70 as shown in FIG. 9 is to be formed the board is formed as shown in FIG. 7D with the spine S between hinges 62, 63 formed by the two creases 60, 61. When there is provided a flat spine the ring mechanism 50 can be secured thereto as illustrated If a round spine 46 is desired a plurality of creases 45 such as shown in FIG. 2 and FIG. 10 are provided. If the unibody construction is not to include glue the process would eliminate the gluing step. Also, if the binder is to be stitched instead of glued the gluing step is eliminated and the stitching step is added after the welding takes place.

As previously noted the cross-section of the board is substantially uniform throughout the covers and the spine area. As previously noted in prior art constructions the spine area is the weakest part of the binder and is subject to wear and tear and subsequent deterioration. This is due to the fact that as discussed with respect to the prior art the hinge includes merely a joining of the outer coverings or a reduction in the board material such as fiberboard, chipboard or similar substrate therein to facilitate hinging of the covers relative to the spine.

Figure 11:
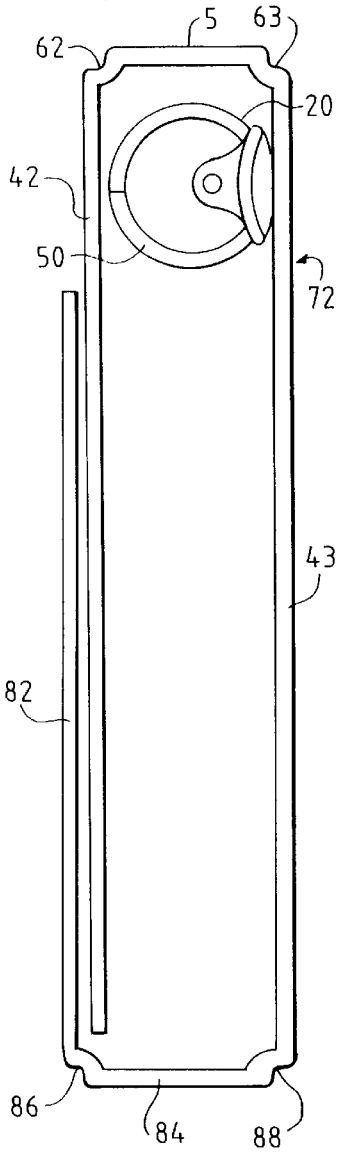
FIG. 11 illustrates a unibody binder construction with a flat spine similar to FIG. 9 and a portfolio closure formed by adding an extension to the back cover by a creased secondary spine.
Figure 12:
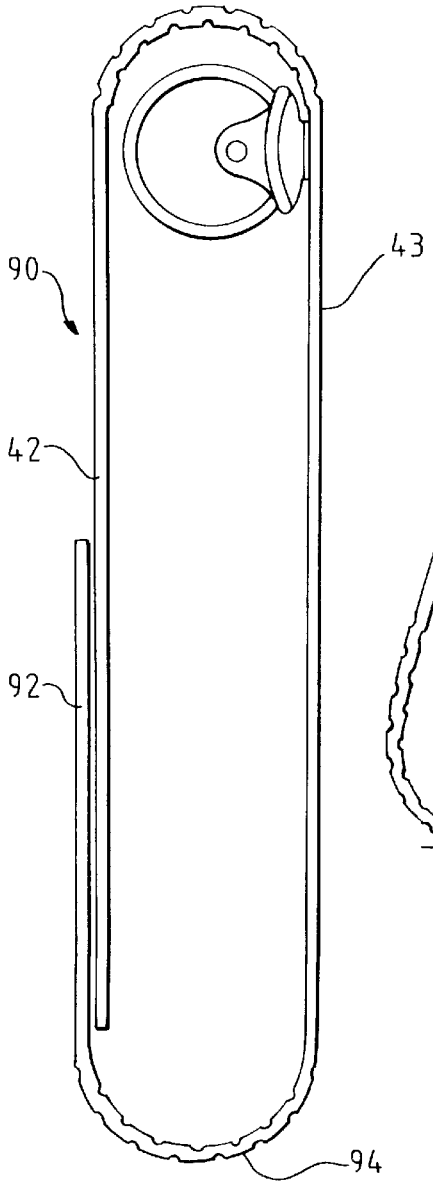
FIG. 12 illustrates a unibody binder construction with a round spine and a flap formed by adding an extension to the back cover by a multiple creased secondary spine.
Figure 13:
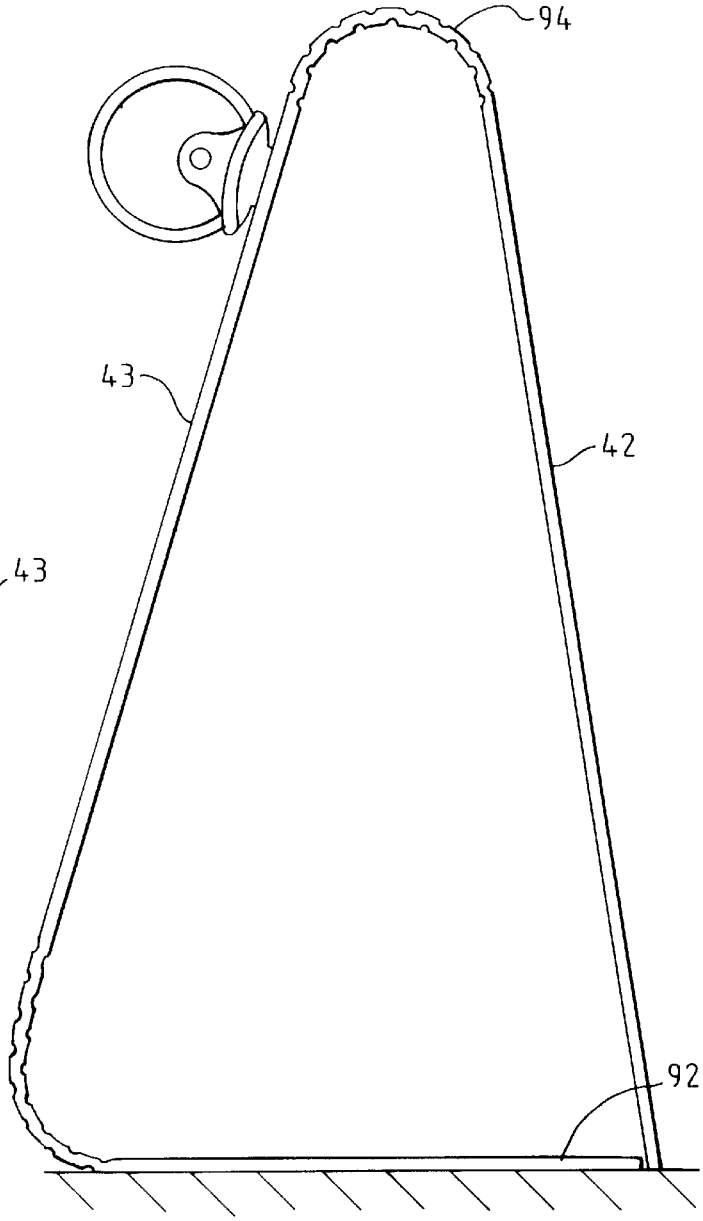
FIG. 13 is a view of the binder of FIG. 12 formed into a flip chart easel.

Referring now to FIGS. 11, 12 and 13 there are illustrated other embodiments of binders that are capable of being formed utilizing the features of the present invention.

In FIG. 11 there is shown a flat spine binder 72 that is similar to FIG. 9 except that the back cover 43 is provided with an extension 82 that overlaps the front cover 42 to give it a portfolio effect. The extension 82 is connected to the back cover 43 by a secondary spine 84 by living hinges 86, 88 that are created in the same manner as living hinges 62, 63.

In another embodiment shown in FIG. 12 there is illustrated a unibody binder 90 that is similar to FIG. 10 in which the back cover 43 is provided with an extension 92 that overlaps the front cover 42. The extension 92 is connected to the back cover 43 by a secondary spine 94 that is formed between cover 43 and extension 92 by a series of living hinges in the same manner as the plurality of creases 45 forming the spine 46 such as shown in FIGS. 2 and 10 are provided.

Turning now to FIG. 13 it is shown that the unibinder construction of FIG. 12 can be repositioned to form the binder into a flip chart configuration with the flap 92 serving as a base. In FIGS. 11, 12, or 13 velcro, snaps, or other closures can be used.

Figure 14:
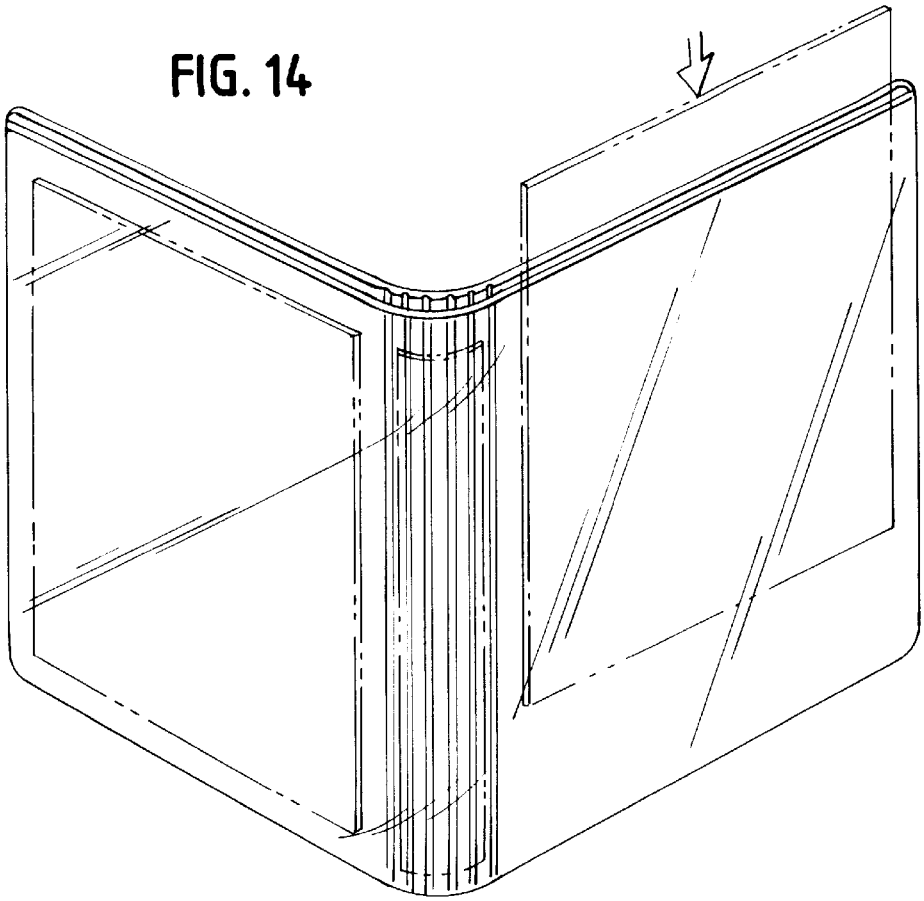
FIG. 14 is a perspective view of a binder similar to that illustrated in FIG. 2 in which there is provided a clear plastic covering connected along three edges to an underlying plastic covered binder and open at the top to receive a billboard across the front cover, spine and back cover.

In FIG. 14 there is illustrated a binder 40 similar to that shown in FIG. 2 that further includes a clear plastic overlay 96 that is sealed or otherwise connected to the bottom and sides of the outer plastic sheet 51. The top edge 96A of the sheet 96 is not connected to the sheet 51 and thus separate sheets 97, 98 of identifying material can be inserted in the space between the clear plastic sheet 96 and the outer plastic cover sheet 51 or if desired a single "billboard" sheet can be inserted that covers the front cover 42 hinge 44 and back cover 43.

Figure 15:
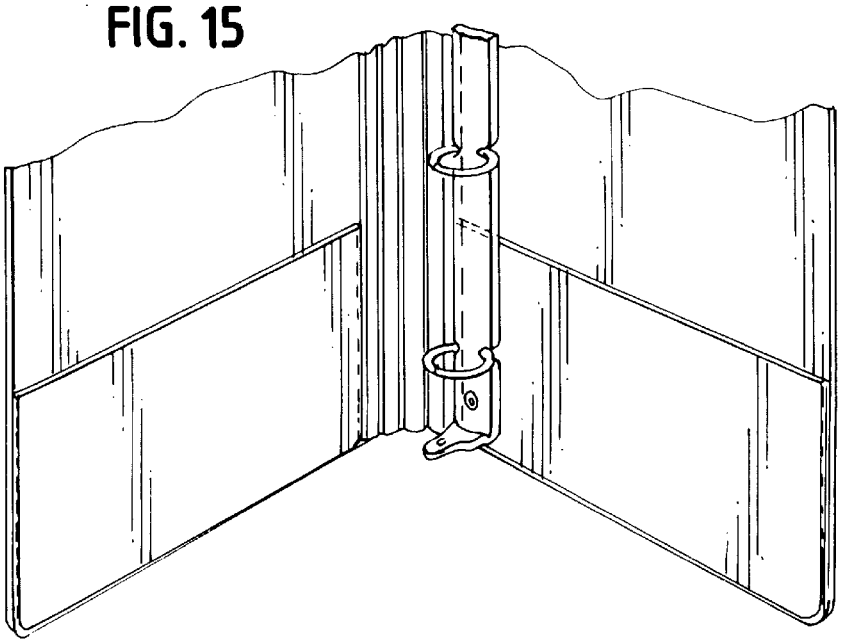
FIG. 15 is an inner view of the binder of FIG. 14 showing pockets for inserts.

As shown in FIG. 15 there is shown partial plastic sheets 99, 100 that are connected on three sides to the front cover 42 and back cover 43 respectively to form pockets 101,102 for receiving inserts.

Thus, it can be seen that there has been provided a novel process for forming a unibody binder comprising a single uncompromised board having plastic coverings that are secured to the board. The board assemblage is then creased to form living hinges and the board can be formed into one having a flat or round spine.

In addition, there is disclosed a number of novel binder embodiments that can be produced utilizing the present invention.

It is intended to cover by the appended claims all features that fall within the true spirit and scope of the invention.

What is claimed is:

1. A unibody binder construction comprising a one piece rigid board having the same thickness throughout including a curved spine formed of a plurality of longitudinally extending creases, said creases forming grooves and said creases having a uniform thickness throughout their longitudinal length and being integral with front and rear binder covers, the uniform thickness of the spine is not diminished by said creases whereby the spine is strong enough to withstand repeated opening and closing of the binder, a ring holder secured to one of said covers and a plastic covering secured to said board.

2. A unibody binder construction as set forth in claim 1 in which the plastic covering is disposed on both sides of said board and secured by welding its edges together.

3. A unibody construction as set forth in claim 2 in which the plastic covering is also glued to said board.

4. A unibody binder construction as set forth in claim 1 in which the plastic covering is disposed on both sides of said board and secured by radio frequency welding its edges together.

5. A unibody binder construction comprising a one piece board of uncompromised uniform thickness having a creased spine formed of a plurality of longitudinally extending creases, said creases forming grooves and said creases having a uniform thickness throughout their longitudinal length and being integral with front and rear covers, the uniform thickness of the spine is not diminished by said creases and plastic sheets surrounding said board and welded together at its edges to firmly secure the sheets to said board, a ring holder secured to said back cover adjacent said spine, said back cover also including an extension secured thereto by a secondary creased spine whereby the extension can overlay the front cover.

6. A unibody binder as set forth in claim 5 in which the spines are in the form of flat sections formed between two creased hinges and the extension connected to the back cover forms a portfolio closure.

7. A unibody binder as set forth in claim 5 in which the spines are formed by a substantial number of creases with each spine taking the form of an arcuate section whereby the binder can be turned into a flip chart easel with the extension serving as a base member and the front cover turned into a back support.

8. A unibody binder construction comprising a one piece board of uncompromised uniform thickness having a creased spine formed of a plurality of longitudinally extending creases, said creases forming grooves and said creases having a uniform thickness throughout their longitudinal length and being integral with front and rear covers, the uniform thickness of the spine is not diminished by said creases, and plastic sheets surrounding said board and welded together at its edges to firmly secure the sheets to said board, a ring holder secured to said back cover adjacent said spine and a clear plastic sheet secured to the bottom and both sides of said front covers to provide an enlarged pocket into which one or more visible inserts may be inserted.

9. A unibody binder construction as set forth in claim 8 in which there is a plastic sheet secured along its bottom and two sides to the plastic sheet covering the inside of the front cover to provide a pocket for inserts.

10. A unibody binder construction as set forth in claim 9 in which a plastic sheet is secured along its bottom and two sides to the plastic sheet covering the inside of the rear cover to provide a pocket for inserts.

11. A unibody binder construction comprising a one piece rigid board having the same thickness throughout including a spine formed between longitudinally extending creases, said creases forming grooves and said creases having a uniform thickness throughout their longitudinal length and being integral with front and rear binder covers, the uniform thickness of the spine is not diminished by said creases, whereby the spine is strong enough to withstand repeated opening and closing of the binder, a ring holder secured to one of said covers and a plastic covering secured to said board.

* * * * *